US008090291B2

(12) United States Patent
Watanabe

(10) Patent No.: US 8,090,291 B2
(45) Date of Patent: Jan. 3, 2012

(54) IMAGE FORMING DEVICE INCLUDING A SHAFT MEMBER WITH REGULATORS PROVIDED THEREON FOR BREAKING UP AN ATTACHMENT/DETACHMENT OPERATION OF AN IMAGE FORMING UNIT

(75) Inventor: Keisuke Watanabe, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 399 days.

(21) Appl. No.: 12/508,479

(22) Filed: Jul. 23, 2009

(65) Prior Publication Data

US 2010/0067944 A1 Mar. 18, 2010

(30) Foreign Application Priority Data

Sep. 12, 2008 (JP) ..... 2008-235026

(51) Int. Cl.
*G03G 15/00* (2006.01)

(52) U.S. Cl. ..... 399/110; 399/111; 399/119; 399/262

(58) Field of Classification Search ..... 399/110, 399/111, 119, 262
See application file for complete search history.

(56) References Cited

U.S. PATENT DOCUMENTS

| | | | | |
|---|---|---|---|---|
| 6,349,192 | B1 * | 2/2002 | Yoshino et al. | 399/302 |
| 7,010,243 | B2 * | 3/2006 | Shimada | 399/111 |
| 2006/0072929 | A1 * | 4/2006 | Takahashi | 399/13 |
| 2007/0230998 | A1 | 10/2007 | Ishii | |
| 2010/0054814 | A1 * | 3/2010 | Sakurai et al. | 399/227 |

FOREIGN PATENT DOCUMENTS

| | | | |
|---|---|---|---|
| JP | S59-151170 | A | 8/1984 |
| JP | H05-066620 | A | 3/1993 |
| JP | H05-257340 | A | 10/1993 |
| JP | 2001-197949 | A | 7/2001 |
| JP | 2001-206562 | A | 7/2001 |
| JP | 2002-302274 | A | 10/2002 |
| JP | 2005-037633 | A | 2/2005 |
| JP | 2005-338180 | A | 12/2005 |
| JP | 2007-271763 | A | 10/2007 |
| JP | 2007-290825 | A | 11/2007 |

OTHER PUBLICATIONS

Japan Patent Office; Notification of Reasons of Rejection in Japanese Patent Application No. 2008-235026 mailed on Jun. 22, 2010.

* cited by examiner

*Primary Examiner* — David Gray
*Assistant Examiner* — G. M. Hyder
(74) *Attorney, Agent, or Firm* — Baker Botts L.L.P.

(57) ABSTRACT

An image forming device includes a main body, an image forming unit configured to be attached to and detached from the main body, the image forming unit being configured to move among first, second, and third positions, a shaft member configured to rotate around an axis line thereof between a first rotational position and a second rotational position, a first regulator provided to the shaft member so as to, when the shaft member is in the first rotational position, engage with the image forming unit and forbid the image forming unit to move between the second position and the third position, and a second regulator provided to the shaft member so as to, when the shaft member is in the second rotational position, engage with the image forming unit and forbid the image forming unit to move between the first position and the second position.

13 Claims, 6 Drawing Sheets

FIG. 1
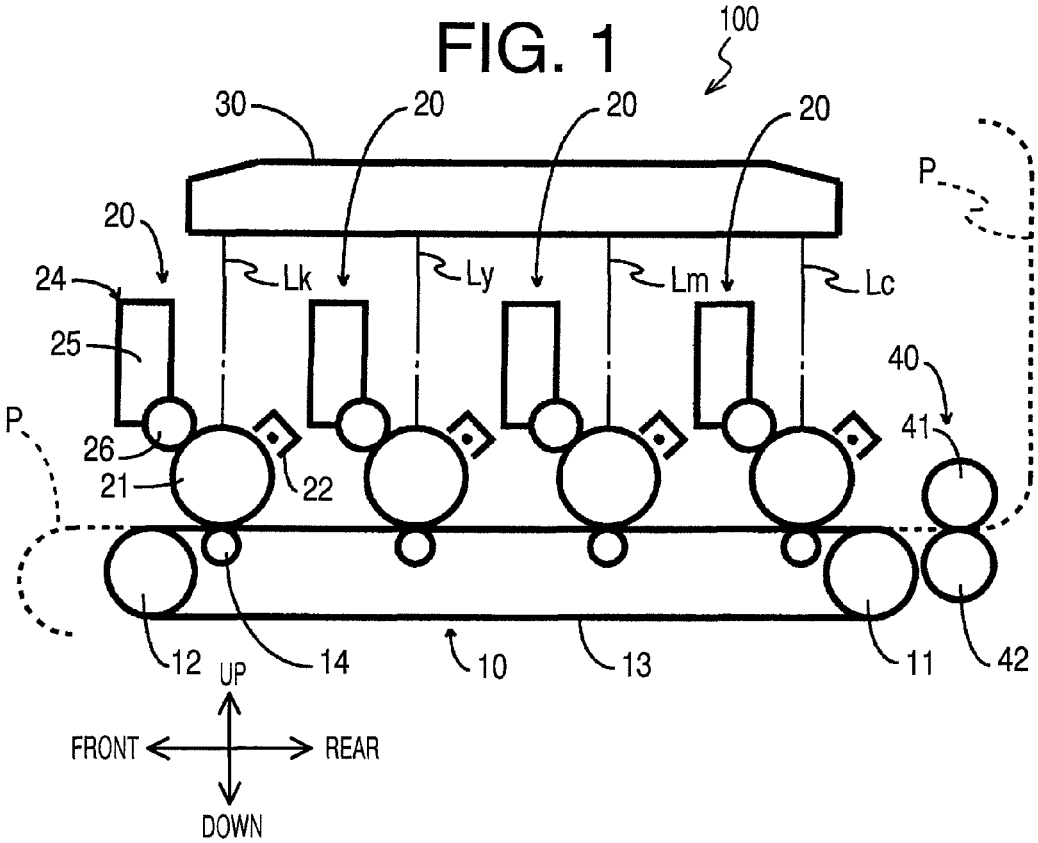
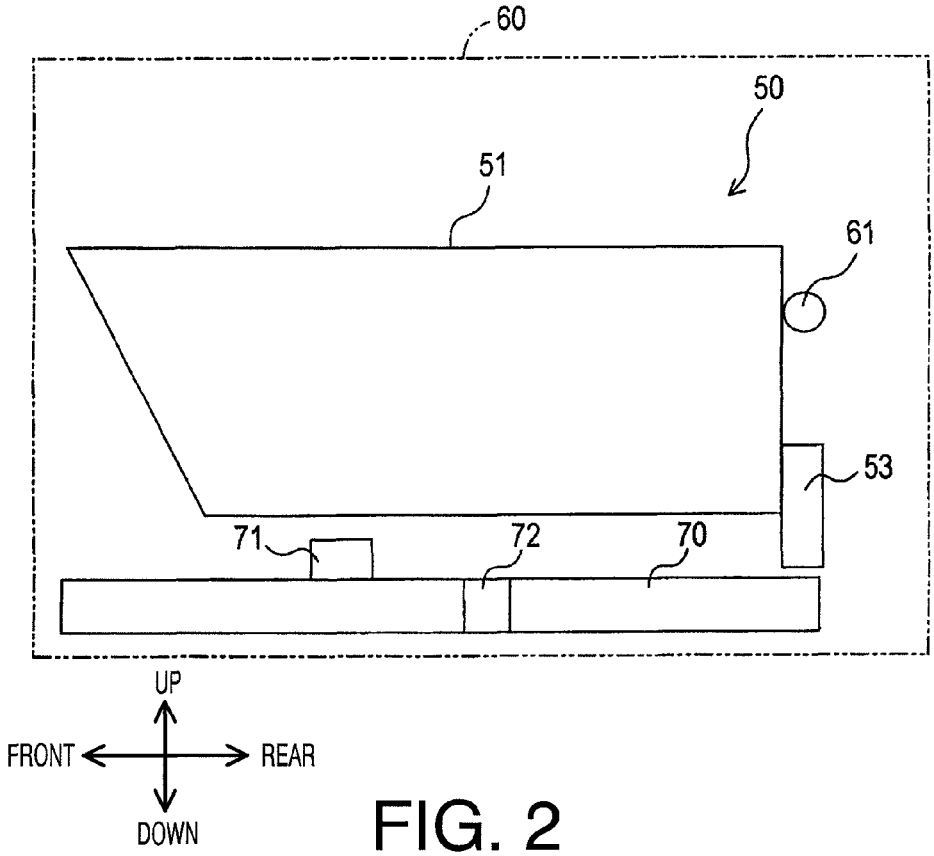
FIG. 2

IMAGE FORMING DEVICE INCLUDING A SHAFT MEMBER WITH REGULATORS PROVIDED THEREON FOR BREAKING UP AN ATTACHMENT/DETACHMENT OPERATION OF AN IMAGE FORMING UNIT

CROSS-REFERENCE TO RELATED APPLICATION

This application claims priority under 35 U.S.C. §119 from Japanese Patent Application No. 2008-235026 filed on Sep. 12, 2008. The entire subject matter of the application is incorporated herein by reference.

BACKGROUND

1. Technical Field

The following description relates to one or more image forming devices each of which has an image forming unit detachably provided to be movable among a first position where the image forming unit is housed in a main body of the image forming device, a second position where the image forming unit is pulled to be exposed to the outside of the main body, and a third position where the image forming unit is separated off from the main body.

2. Related Art

So far an image forming device has been proposed which has an image forming unit detachably provided to be movable among a first position where the image forming unit is housed in a main body of the image forming device so as to form an image on a recording sheet, a second position where the image forming unit is pulled to be exposed to the outside of the main body, and a third position where the image forming unit is separated off from the main body. Further, for the image forming device of this kind, a configuration provided with a regulator has been proposed. In such a configuration, when the regulator is placed in a regulation position, the movement of the image forming unit is allowed between the first position and the second position and forbidden between the second position and the third position. Further, when the regulator is placed in an allowance position, the movement of the image forming unit is forbidden between the first position and the second position and allowed between the second position and the third position.

In this case, when the image forming unit is pulled, it is possible to prevent the image forming unit from being pulled out at a stroke from the first position to the third position and being dropped down to a floor. Further, when the image forming unit is attached, it is possible to prevent the image forming unit from being pushed at a stroke from the third position to the first position and to prevent an internal positioning portion from being worn away.

SUMMARY

However, the image forming unit is required to have a first portion and a second portion provided apart from each other in a direction in which the image forming unit is detached. Here, the first portion is a portion that causes interference with the regulator placed in the allowance position and does not cause interference with the regulator placed in the regulation position. Additionally, the second portion is a portion that causes interference with the regulator placed in the regulation position and does not cause interference with the regulator placed in the allowance position. Thus, it results in a complicated configuration of the image forming unit.

Aspects of the present invention are advantageous to provide one or more improved image forming devices, each of which achieve a simplified configuration even with an image forming unit detachably provided to be movable among a first position where the image forming unit is housed in a main body of the image forming device, a second position where the image forming unit is pulled to be exposed to the outside of the main body, and a third position where the image forming unit is separated off from the main body.

According to aspects of the present invention, an image forming device is provided which includes a main body, an image forming unit configured to be attached to and detached from the main body along a predetermined direction, the image forming unit being configured to move among a first position where the image forming unit is housed in the main body, a second position where the image forming unit is pulled from the main body to be exposed to an outside of the main body, and a third position where the image forming unit is separated off from the main body, a shaft member elongated in the predetermined direction, the shaft member being configured to rotate around an axis line thereof extending along the predetermined direction, between a first rotational position and a second rotational position apart from the first rotational position by a predetermined rotational angle, a first regulator provided to the shaft member, the first regulator being configured to, when the shaft member is in the first rotational position, engage with the image forming unit and forbid the image forming unit to move between the second position and the third position, and a second regulator provided to the shaft member, the second regulator being configured to, when the shaft member is in the second rotational position, engage with the image forming unit and forbid the image forming unit to move between the first position and the second position.

According to aspects of the present invention, further provided is an image forming device which includes a main body, an image forming unit configured to be attached to and detached from the main body along a predetermined direction, the image forming unit being configured to move among a first position where the image forming unit is housed in the main body, a second position where the image forming unit is pulled from the main body to be exposed to an outside of the main body, and a third position where the image forming unit is separated off from the main body, a reference member provided to the main body, the reference member being configured to determine the first position of the image forming unit by establishing contact with the image forming unit, a stopper provided to the image forming unit, a shaft member elongated in the predetermined direction, the shaft member being configured to rotate around an axis line thereof extending along the predetermined direction, an operation member provided to the shaft member, the operation member being configured to be externally operated so as to rotate the shaft member, a rotation regulator provided to the shaft member, the rotation regulator being configured to allow the shaft member to rotate between a first rotational position and a second rotational position apart from the first rotational position by a predetermined rotational angle, a first regulator provided to the shaft member, the first regulator being configured to, when the shaft member is in the first rotational position, engage with the stopper of the image forming unit and forbid the image forming unit to move between the second position and the third position, and a second regulator provided to the shaft member, the second regulator being configured to, when the shaft member is in the second rotational position, engage with the stopper of the image forming unit and forbid the image forming unit to move between the first position and the second position.

BRIEF DESCRIPTION OF THE ACCOMPANYING DRAWINGS

FIG. 1 schematically shows an internal configuration of an image forming device in an embodiment according to one or more aspects of the present invention.

FIG. 2 schematically shows a configuration of a drum subunit and surrounding elements of the image forming device in the embodiment according to one or more aspects of the present invention.

FIGS. 3A and 3B are respectively a perspective view and a front view showing a configuration of a shaft member disposed near the drum subunit in the embodiment according to one or more aspects of the present invention.

FIG. 4A schematically shows a dial provided at a front end of the shaft member in the embodiment according to one or more aspects of the present invention.

FIG. 4B schematically shows a rotation regulator provided at a rear end of the shaft member in the embodiment according to one or more aspects of the present invention.

Figure 8A:
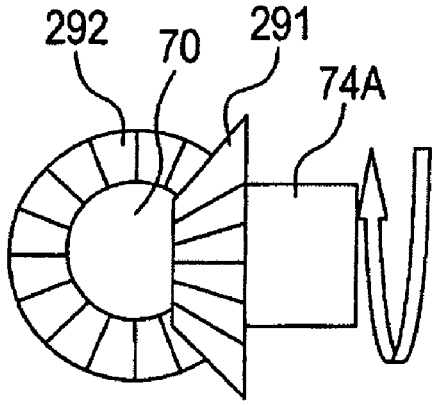

FIG. 8A schematically shows a configuration of a rotational shaft of the dial provided to be perpendicular to the shaft member in a modification according to one or more aspects of the present invention.

Figure 8B:
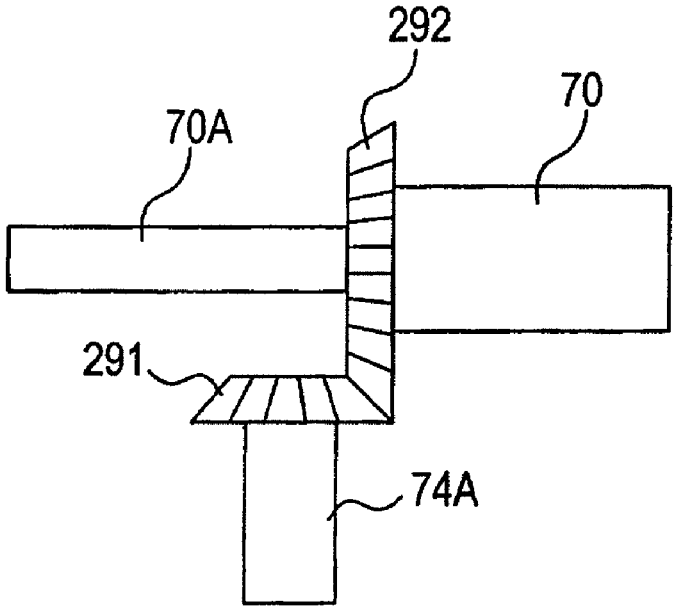

FIG. 8B schematically shows another configuration of a rotational shaft of the dial provided to be perpendicular to the shaft member in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

[Overall Configuration of Laser Printer]

Hereinafter, an embodiment according to aspects of the present invention will be described with reference to the accompanying drawings. FIG. 1 schematically shows an internal configuration of an image forming device 100 in an embodiment. It is noted that the following description will be given with the left side in FIG. 1 defined as the front side of the image forming device 100. Further, FIG. 1 schematically shows a configuration of each element with the configuration partially omitted for the sake of explanatory convenience, and the figure is not necessarily consistent with other drawings.

As illustrated in FIG. 1, the image forming device 100 of the embodiment includes a belt unit 10 configured with a feeding belt (transfer belt) 13 wound around a driving roller 11 and a driven roller 12, and four process units 20, corresponding to four colors of black (K), yellow (Y), magenta (M), and cyan (C), respectively, which are disposed above the belt unit 10. The four process units 20 are aligned in a front-to-rear direction in the order of the black (K), yellow (Y), magenta (M), and cyan (C) from the front side, and thus configured as a direct tandem color image forming unit.

Each of the process units 20 is configured with a photoconductive drum 21, a scorotron charger 22, and a development cartridge 24. The photoconductive drum 21 includes a metal drum body connected to ground with a surface thereof covered with a positively-electrifiable photoconductive layer.

The scorotron charger 22 is disposed a predetermined distance away from the photoconductive drum 21, at an obliquely upper rear side of the photoconductive drum 21, so as to face the photoconductive drum 21. The scorotron charger 22 is configured to cause an electrification wire thereof such as a tungsten wire to generate corona discharge and to charge the surface of the photoconductive drum 21 positively and evenly. The development cartridge 24 has a toner container 25 provided therein. The development cartridge 24 is a known one configured to positively charge, in a frictional manner, one-component positively-electrifiable nonmagnetic toner of a corresponding one color of the black (K), cyan (C), magenta (M), and yellow (Y), which is stored in the toner container 25 and to supply the toner to the photoconductive drum 21 via a development roller 26.

Further, the belt unit 10 has four transfer rollers 14 provided to face the photoconductive drums 21 across the feeding belt 13, respectively. The feeding belt 13 is driven to turn in the clockwise direction in FIG. 1 by clockwise rotation of the driving roller 11. A sheet P is fed onto the surface of the feeding belt 13 by various rollers (not shown) such as a feed roller, from a feed tray (no shown) inserted into a lower portion of the image forming device 100. Then, the sheet P is conveyed to the rear side of the image forming device 100, passing through a position to face each photoconductive drum 21.

A scanner unit 30 is provided above the process units 20. The scanner unit 30, which is a known one configured to scan and expose the photoconductive drums 21, includes semiconductor lasers (not shown) configured to emit laser beams Lk, Ly, Lm, and Lc corresponding to four colors of image data, respectively, and polygon mirrors (not shown) configured to deflect the laser beams L (Lk, Ly, Lm, and Lc), respectively.

Therefore, first, the surface of each photoconductive drum 21 is charged evenly and positively by the charger 22 while being rotating. Thereafter, the surface of the photoconductive drum 21 is exposed through high-speed scanning of the laser beam L emitted by the scanner unit 30, and thus an electrostatic latent image, which corresponds to an image to be formed on the sheet P, is formed on the surface of the photoconductive drum 21. Subsequently, the positively charged toner held on the development roller 26 is supplied to the electrostatic latent image formed on the surface of the photoconductive drum 21 through rotation of the development roller 26 when facing and contacting the photoconductive drum 21. Thereby, the electrostatic latent image on the photoconductive drum 21 is developed into a visible image as a toner image formed with the toner attached to exposed portions on the surface of the photoconductive drum 21.

After that, the toner image held on the surface of each photoconductive drum 21 is sequentially transferred onto the sheet P by a negative transfer bias applied to the transfer roller 14 under constant current control when the sheet P being conveyed by the feeding belt 13 passes between the photoconductive drum 21 and the transfer roller 14. Next, the sheet P with the toner transferred thereon in this manner is conveyed to a fixing unit 40 provided behind the belt unit 10.

The fixing unit 40 includes a heating roller 41 that is provided with a heat source and configured to be rotated, and a pressing roller 42 that is disposed below the heating roller 41 so as to face and press the heating roller 41 and configured to be rotated in accordance with rotation of the heating roller 41. The fixing unit 40 heats the sheet P with four colors of toner images formed thereon while pinching and conveying between the heating roller 41 and the pressing roller 42, and thus thermally fixes the toner images on the sheet P. Then, the sheet P with the toner images thermally fixed thereon is ejected by various rollers (not shown) onto a catch tray (not shown) provided on an upper surface of the image forming device 100.

[Configuration of Main Body Frame]

The aforementioned four process units 20 are stored in a drum subunit 50 as shown in FIG. 2. The drum subunit 50 rotatably supports the four photoconductive drums 21 in a case 51 configured as a ship-shaped container with an upper side thereof opened. Further, each of the development cartridges 24 is attached to the case 51 in an individually detachable manner. Additionally, the drum subunit 50 is configured to be attached to and detached from a frame 60 constituting a main body of the image forming device 100, from the front side of the frame 60. The frame 60 has a reference shaft 61 that is elongated in a right-to-left direction (i.e., a direction perpendicular to FIG. 2) and configured to determine a set position of the drum subunit 50 (hereinafter referred to as a first position) by establishing contacting with a rear end of the case 51. Moreover, in a position of the case 51 where the case 51 establishes contact with the reference shaft 61, a notched portion may be formed to engage with the reference shaft 61.

Figure 3A:
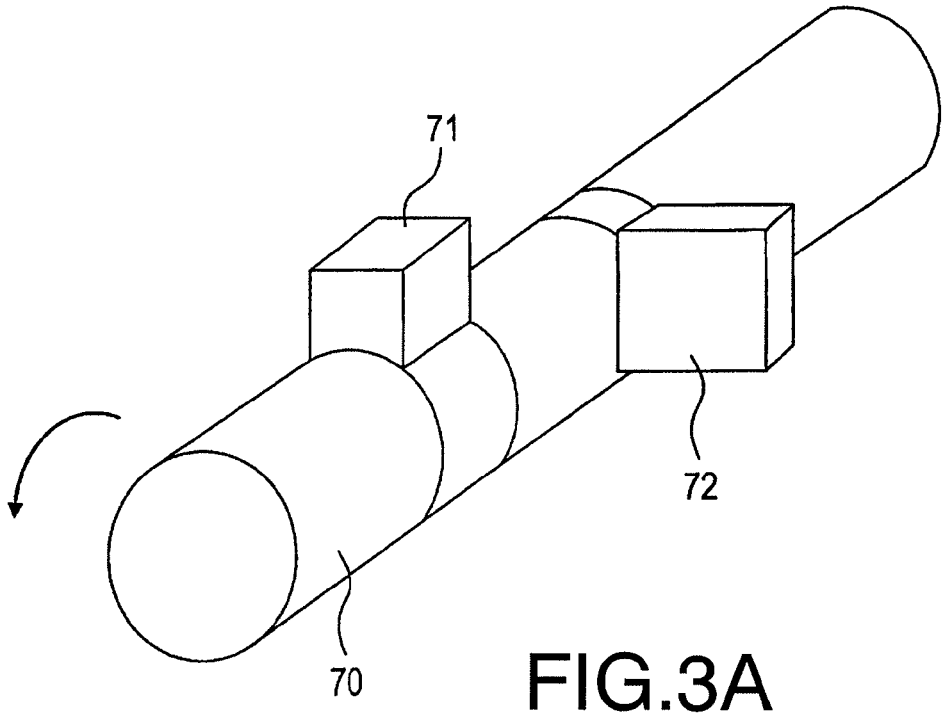
Figure 3B:
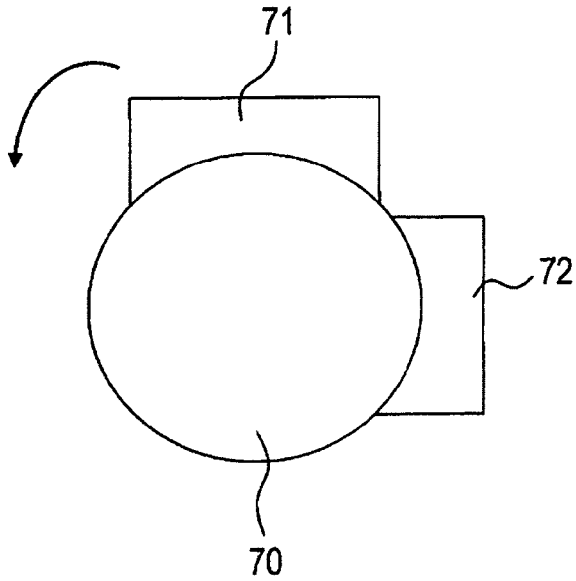

Further, a shaft member 70, elongated in the front-to-rear direction, is provided in a position that is below the drum subunit 50 set in the first position and adjacent to the belt unit 10 in the right-to-left direction. The shaft member 70 is supported by the frame 60, rotatably around an axis line of the shaft member 70. As illustrated in FIGS. 2, 3A, and 3B, around an outer circumferential surface of the shaft member 70, a first projection 71 and a second projection 72 are provided, each of which is configured to protrude in a rectangular parallelepiped shape from the shaft member 70.

FIGS. 3A and 3B are a perspective view and a front view showing a configuration of the shaft member 70, respectively. As illustrated in FIGS. 3A and 3B, the first projection 71 and the second projection 72 protrude in respective directions that are 90 degrees spaced from one another around the axis line of the shaft member 70. Further, the second projection 72 is placed behind the first projection in the front-to-rear direction. As illustrated in FIG. 2, a stopper 53 is provided at a rear end of the case 51 and configured to protrude downward and engage with a projection directed up of the first projection 71 and the second projection 72. It is noted that a position where the stopper 53 engages with the first projection 71 from the rear side is, in the front-to-rear direction, behind a position where the drum subunit 50 is separated off from the frame 60 (hereinafter referred to as a third position). Further, in a position where the stopper 53 engages with the second projection 72 from the front, any part of the drum subunit 50 does not contact the reference shaft 61.

Figure 4A:
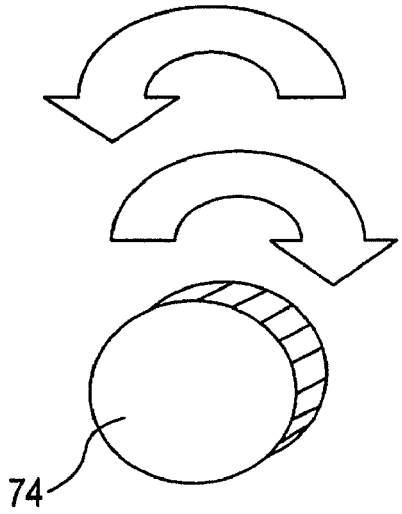
Figure 4B:
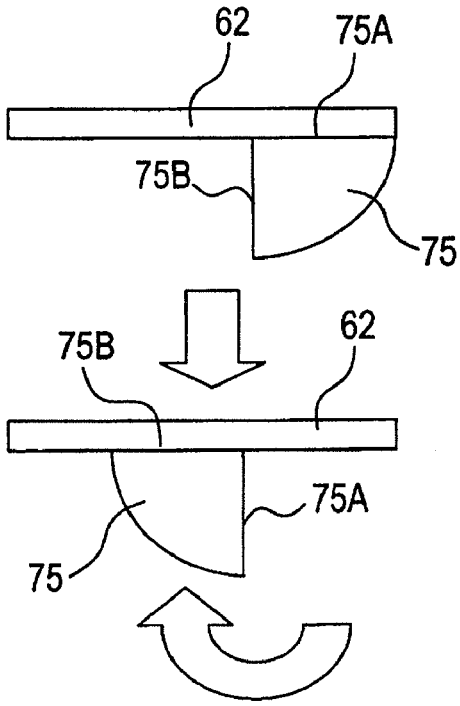

It is not shown in any of FIGS. 2 and 3, but a dial 74 and a rotation regulator 75 are provided at a front end and a rear end of the shaft member 70, respectively. More specifically, the dial as shown in FIG. 4A is fixed to the front end of the shaft member 70. The user can rotate the shaft member 70 by rotating the dial 74 in directions indicated by arrows in FIG. 4A. In addition, as illustrated in a rear view of FIG. 4B, the rotation regulator 75, formed integrally with the rear end of the shaft member 70, is configured in a sector form with a center angle of 90 degrees around a rotational center of the shaft member 70. When either of two sides 75A and 75B of the rotation regulator 75 establishes contact with a lower surface of a plate 62 which is horizontally fixed to the frame 60, the rotation of the shaft member 70 is restricted. Specifically, when the side 75A contacts the lower surface of the plate 62, the shaft member 70 is set to a first rotational position with the first projection 71 up. Meanwhile, when the side 75B contacts the lower surface of the plate 62, the shaft member 70 is set to a second rotational position with the second projection 72 up.

[Effects of Embodiment]

Figure 5A:
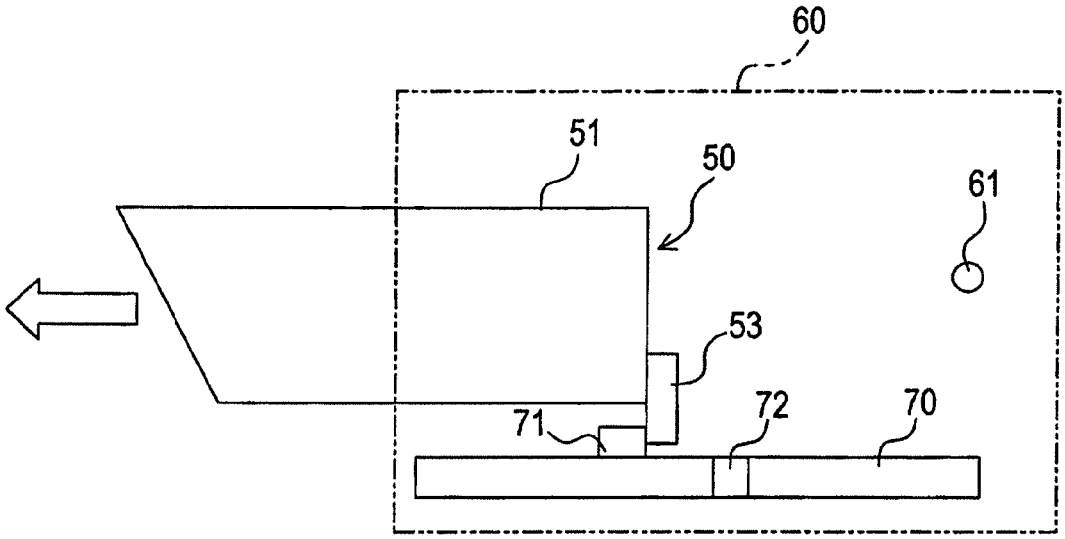
FIGS. 5A and 5B illustrate operations of the shaft member when the drum subunit is pulled from a frame in the embodiment according to one or more aspects of the present invention.

In the image forming device configured as above in the embodiment, when the dial 74 is operated and the shaft member 70 is set to the first rotational position before the drum subunit 50 is pulled, the first projection 71 is set to protrude up. It is noted that, as described below, in a state where the drum subunit 50 is attached to the frame 60, the shaft member 70 is set in the first rotational position. When the drum subunit 50 is pulled from this state, as illustrated in FIG. 5A, the stopper 53 comes into engagement with the first projection 71 from the rear side before the drum subunit 50 is separated off from the frame 60. Therefore, it is possible to prevent the drum subunit 50 from being pulled at a stroke from the first position to the third position and being dropped down.

Figure 5B:
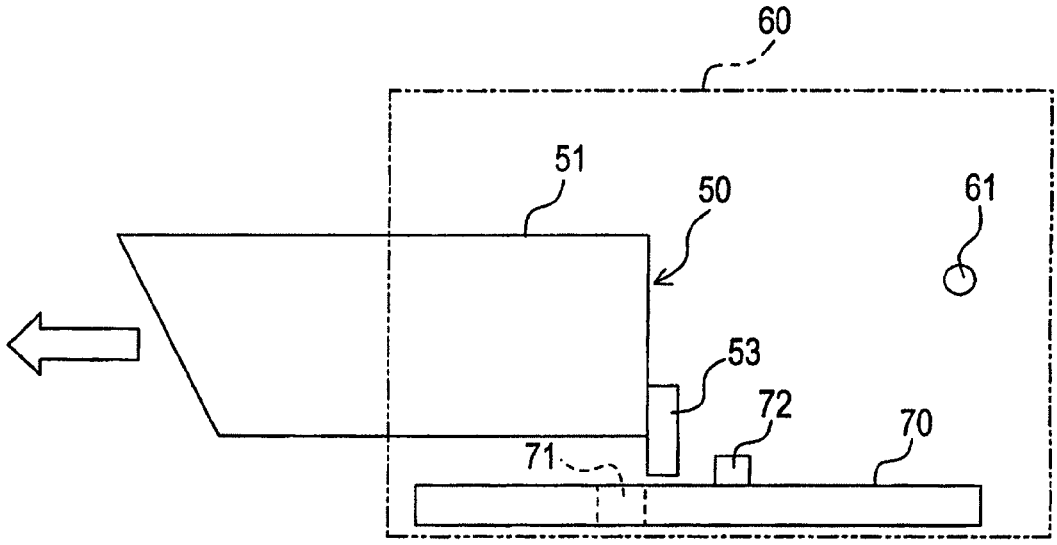

When the shaft member 70 is rotated to the second rotational position after the stopper 53 has established engagement with the first projection 71, as illustrated in FIG. 5B, the first projection 71 is turned down. Thus, it is possible to move the drum subunit 50 to the third position and detach the drum subunit 50 from the frame 60.

Figure 6A:
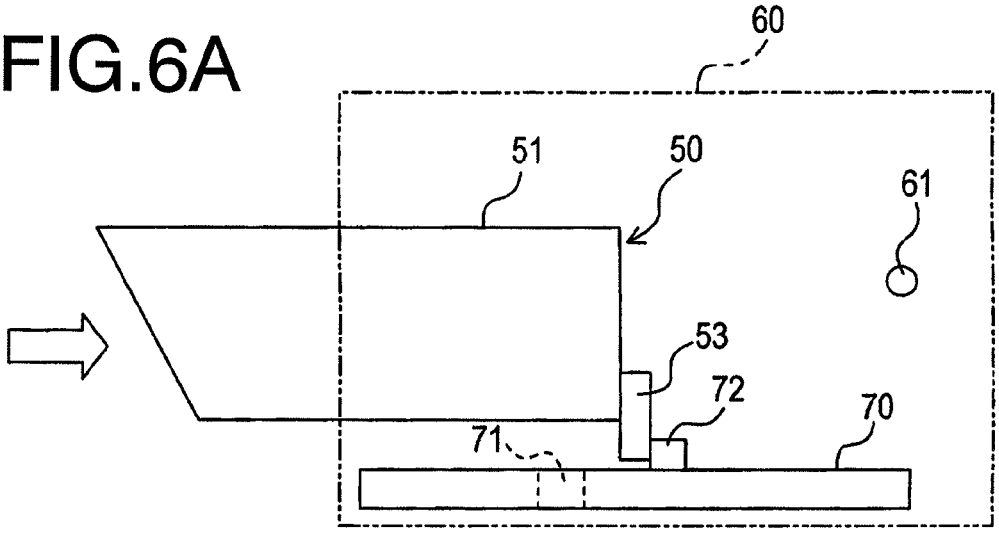
FIGS. 6A and 6B illustrate operations of the shaft member when the drum subunit is inserted into the frame in the embodiment according to one or more aspects of the present invention.

Meanwhile, when the shaft member 70 is rotated to the second rotational position before the drum subunit 50 is attached, the second projection 72 is set to protrude up. It is noted that, as described above, the shaft member 70 is set in the second rotational position in a state where the drum subunit 50 is detached. When the drum subunit 50 is attached to the frame 60 from this state, as illustrate in FIG. 6A, the stopper 53 comes into engagement with the second projection 72 from the front side before the drum subunit 50 establishes contact with the reference shaft 61. Hence, it is possible to prevent the drum subunit 50 from being pushed at a stroke from the third position to the first position and to prevent the reference shaft 61 from being worn away.

Figure 6B:
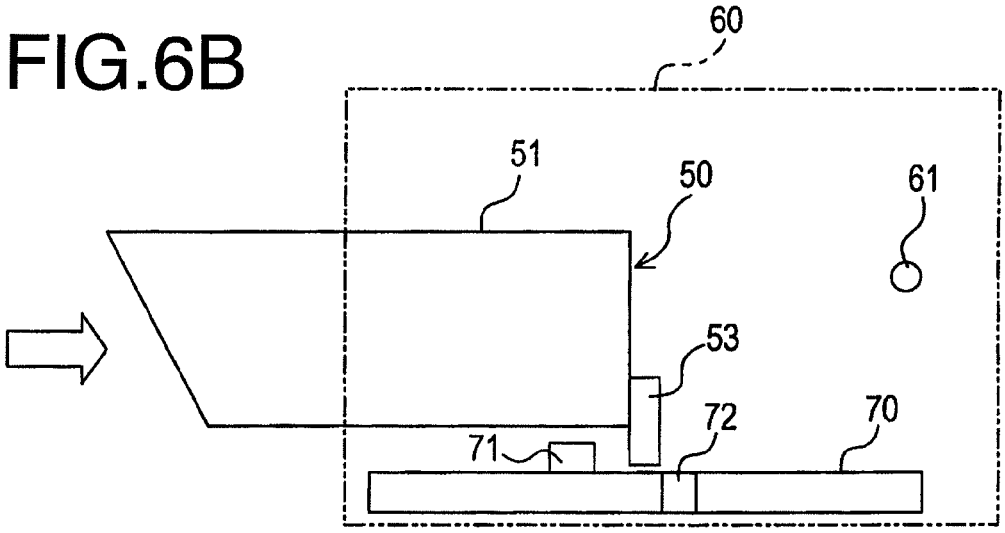

When the shaft member 70 is rotated to the first rotational position after the stopper 53 has established engagement with the second projection 72, as illustrated in FIG. 6B, the second projection 72 is turned down. Thus, the drum subunit 50 can be moved to the first position. Then, a positional relationship between the belt unit 10 supported by the frame 60 and each photoconductive drum 21 supported by the drum subunit 50 comes to the state as shown in FIG. 1 where the image forming device 100 can form an image on the sheet P.

Thus, in the embodiment, the first projection 71 and the second projection 72 are provided to the shaft member 70 elongated in the front-to-rear direction in which the drum subunit 50 is attached or detached. The first projection 71 and the second projection 72 are placed apart from one another in the front-to-rear direction. Further, either the first projection 71 or the second projection 72 protrudes up depending on the rotational position of the shaft member 70. Therefore, only by providing the single stopper 53 to the drum subunit 50 as a member configured to engage with the first projection 71 and the second projection 72, it is possible to regulate the movement of the drum subunit 50 as mentioned above and thus to simplify the configuration of the drum subunit 50. It is noted that, in the embodiment, a position where the stopper 53 is placed between the first projection 71 and the second projection 72 corresponds to a second position.

Further, in the embodiment, owing to the sides 75A and 75B of the rotation regulator 75 configured to contact the plate 62, the rotation of the shaft member 70 is restricted between the first rotational position and the second rotational position. Thus, it is possible to easily turn the shaft member 70 up to the first rotational position or the second rotational position.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein. For example, the following modifications are possible.

[Modifications]

Figure 7:
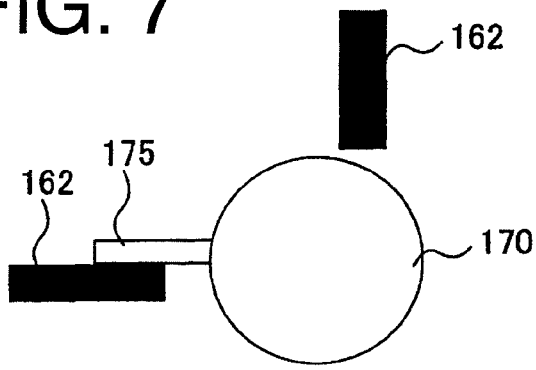
FIG. 7 is a rear view of a rotation regulating plate which protrudes outward from a shaft member in a modification according to one or more aspects of the present invention.

Various configurations may be applied as substitute for the rotation regulator 75. For instance, as illustrated in FIG. 7, a rotation regulating plate 175 which protrudes outward from a shaft member 170 may be provided to establish contact with any one of mark plates 162.

Further, as illustrated in FIG. 8A, a rotational shaft 74A of the dial 74 and a front end of the shaft member 70 may be connected with each other via bevel gears 291 and 292. In this case, it is possible to allow the rotational shaft 74A of the dial 74 to rotate around an axis perpendicular to the axis line of the shaft member 70 (see an arrow in FIG. 8A). Thus, it is possible to present greater flexibility with respect to the location of the dial 74 and an easier operation of rotating the shaft member 70. Further, in this case, as illustrated in FIG. 8B, the shaft member 70 may be provided with a supporter 70A that penetrates the bevel gear 292 and protrudes forward so as to position the rotational shaft 74A.

Further, the shaft member 70 may be provided below the drum subunit 50, in the same manner at each side of the belt unit 10 in the right-to-left direction. In this case, the shaft members 70 may be interlocked with each other via a belt, gears, a link, or the like. Additionally, when the belt unit 10 is housed together in the drum subunit 50, the shaft member 70 may be provided below the drum subunit 50, at a center in the right-to-left direction. Furthermore, the shaft member 70 may be at each side of the drum subunit 50 in the right-to-left direction or above the drum subunit 50.

Further, the first projection 71 and the second projection 72 may be configured to engage with the development cartridges 24 attached to the drum subunit 50. However, in the aforementioned embodiment, the first projection 71 and the second projection 72 engage with the case 51 of the drum subunit 50 via the stopper 53. Hence, even though the development cartridges 24 are not completely attached to the case 51, or some of the development cartridges 24 are forgot to be attached to the case 51, it is possible to certainly regulate the movement of the drum subunit 50. In the aforementioned embodiment, the shaft member 70 is formed in a column-shape. However, the shaft member 70 may be formed to be hollow or to have a cross-section in a cross-shape or a U-shape.

What is claimed is:

1. An image forming device, comprising:

a main body;

an image forming unit configured to be attached to and detached from the main body along a predetermined direction, the image forming unit being configured to move among a first position where the image forming unit is housed in the main body, a second position where the image forming unit is pulled from the main body to be exposed to an outside of the main body, and a third position where the image forming unit is separated off from the main body;

a shaft member elongated in the predetermined direction, the shaft member being configured to rotate around an axis line thereof extending along the predetermined direction, between a first rotational position and a second rotational position apart from the first rotational position by a predetermined rotational angle;

a first regulator provided to the shaft member, the first regulator being configured to, when the shaft member is in the first rotational position, engage with the image forming unit and forbid the image forming unit to move between the second position and the third position; and a second regulator provided to the shaft member, the second regulator being configured to, when the shaft member is in the second rotational position, engage with the image forming unit and forbid the image forming unit to move between the first position and the second position.

2. The image forming device according to claim 1, wherein the image forming unit comprises:

a main body unit having therein an electrostatic latent image holding body configured to hold an electrostatic latent image on a surface thereof; and a development cartridge configured to be attached to and detached from the main body unit, the development cartridge being configured to develop the electrostatic latent image held on the surface of the electrostatic latent image holding body by rendering developer adhere onto the electrostatic latent image, and wherein each of the first regulator and the second regulator is configured to engage with the main body unit.

3. The image forming device according to claim 1, wherein the image forming unit comprises a stopper, and wherein each of the first regulator and the second regulator is configured to engage with the stopper.

4. The image forming device according to claim 2, wherein the image forming unit of the image forming unit comprises a stopper, and wherein each of the first regulator and the second regulator is configured to engage with the stopper.

5. The image forming device according to claim 1, wherein the main body comprises a reference member configured to determine the first position of the image forming unit by establishing contact with the image forming unit.

6. The image forming device according to claim 2, wherein the main body comprises a reference member configured to determine the first position of the image forming unit by establishing contact with the main body unit of the image forming unit.

7. The image forming device according to claim 1, further comprising a rotation regulator provided to the shaft member, the rotation regulator being configured to allow the shaft member to rotate between the first rotational position and the second rotational position.

8. The image forming device according to claim 1, further comprising an operation member provided to the shaft member, the operation member being configured to be externally operated so as to rotate the shaft member.

9. The image forming device according to claim 8, wherein the operation member is configured to rotate around a predetermined axis intersecting with the axis line of the shaft member, and wherein the image forming device further comprises a transmitter provided between the operation member and the shaft member, the transmitter being configured to transmit rotation of the operation member to the shaft member.

10. The image forming device according to claim 9, wherein the transmitter comprises a plurality of bevel gears.

11. The image forming device according to claim 1, wherein the first regulator is configured to prevent the image forming unit from moving from the second position to the third position, and wherein the second regulator is configured to prevent the image forming unit from moving from the second position to the first position.

12. The image forming device according to claim 1, wherein the first regulator and the second regulator are configured to protrude from an outer circumferential surface of the shaft member in respective directions that are a predetermined angle spaced from one another, at respective locations that are a predetermined distance spaced from one another in the predetermined direction.

13. An image forming device, comprising:

a main body;

an image forming unit configured to be attached to and detached from the main body along a predetermined direction, the image forming unit being configured to move among a first position where the image forming unit is housed in the main body, a second position where the image forming unit is pulled from the main body to be exposed to an outside of the main body, and a third position where the image forming unit is separated off from the main body;

a reference member provided to the main body, the reference member being configured to determine the first position of the image forming unit by establishing contact with the image forming unit;

a stopper provided to the image forming unit;

a shaft member elongated in the predetermined direction, the shaft member being configured to rotate around an axis line thereof extending along the predetermined direction;

an operation member provided to the shaft member, the operation member being configured to be externally operated so as to rotate the shaft member;

a rotation regulator provided to the shaft member, the rotation regulator being configured to allow the shaft member to rotate between a first rotational position and a second rotational position apart from the first rotational position by a predetermined rotational angle;

a first regulator provided to the shaft member, the first regulator being configured to, when the shaft member is in the first rotational position, engage with the stopper of the image forming unit and forbid the image forming unit to move between the second position and the third position; and a second regulator provided to the shaft member, the second regulator being configured to, when the shaft member is in the second rotational position, engage with the stopper of the image forming unit and forbid the image forming unit to move between the first position and the second position.

* * * * *